US011326568B2

(12) United States Patent
Iwa et al.

(10) Patent No.: US 11,326,568 B2
(45) Date of Patent: May 10, 2022

(54) DAMPER DEVICE

(71) Applicant: EAGLE INDUSTRY CO., LTD., Tokyo (JP)

(72) Inventors: Toshiaki Iwa, Tokyo (JP); Yoshihiro Ogawa, Tokyo (JP); Yusuke Sato, Tokyo (JP); Koji Sato, Tokyo (JP); Takayuki Kondo, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 17/050,422

(22) PCT Filed: May 22, 2019

(86) PCT No.: PCT/JP2019/020195
§ 371 (c)(1),
(2) Date: Oct. 23, 2020

(87) PCT Pub. No.: WO2019/225627
PCT Pub. Date: Nov. 28, 2019

(65) Prior Publication Data

US 2021/0071628 A1 Mar. 11, 2021

(30) Foreign Application Priority Data

May 25, 2018 (JP) ..... JP2018-100427

(51) Int. Cl.
*F02M 55/04* (2006.01)
*F02M 59/44* (2006.01)

(52) U.S. Cl.
CPC ..... *F02M 55/04* (2013.01); *F02M 59/44* (2013.01); *F02M 2200/315* (2013.01); *F02M 2200/8084* (2013.01)

(58) Field of Classification Search
CPC .. F02M 55/04; F02M 59/44; F02M 2200/315; F02M 2200/8084; F02M 2200/8053; F02M 37/0041; F16L 55/05
See application file for complete search history.

(56) References Cited

U.S. PATENT DOCUMENTS 3,020,928 A 2/1962 William ..... 138/30
4,728,085 A 3/1988 Bebermeier ..... 267/122
(Continued)

FOREIGN PATENT DOCUMENTS

CN 1219993 6/1999 ..... F01B 19/00
CN 103097716 5/2013 ..... F02M 59/44
(Continued)

OTHER PUBLICATIONS

U.S. Appl. No. 17/048,568, filed Oct. 16, 2020, Sato et al.
(Continued)

*Primary Examiner* — George C Jin
(74) *Attorney, Agent, or Firm* — Hayes Soloway P.C.

(57) ABSTRACT

There is provided a damper device that can be held in a housing space with simple work. A damper device, which is disposed and used in a housing space formed in a device unit, includes: a damper body that is filled with gas and includes a diaphragm provided with a deformable-action portion formed at a central portion thereof; and an annular clip that holds an outer peripheral edge portion of the damper body and causes a biasing force to act on an inner wall of a cover member, which forms the housing space, in a radial direction.

4 Claims, 7 Drawing Sheets

(56) References Cited

U.S. PATENT DOCUMENTS

| | | | | |
|---|---|---|---|---|
| 5,743,170 | A | 4/1998 | Pascual et al. | 92/103 |
| 7,004,733 | B2 | 2/2006 | Schepp | B60T 8/4031 |
| 8,366,421 | B2 | 2/2013 | Munakata | 417/540 |
| 8,562,315 | B2 | 10/2013 | Inoue | 417/540 |
| 8,727,752 | B2 | 5/2014 | Lucas | 417/541 |
| 8,757,212 | B2 | 6/2014 | Bartsch | 138/30 |
| 8,955,550 | B2 | 2/2015 | Oikawa | 138/30 |
| 9,057,348 | B2 | 2/2015 | Usui | F02M 55/04 |
| 9,803,600 | B2 * | 10/2017 | Nah | F02M 37/0041 |
| 9,828,988 | B2 | 11/2017 | Koehler | F02M 59/44 |
| 10,480,466 | B2 | 11/2019 | Tomitsuka et al. | F02M 37/0041 |
| 10,480,704 | B2 | 11/2019 | Yoshida | F02M 55/00 |
| 10,544,768 | B2 | 1/2020 | Kashiwagi | F02M 59/44 |
| 10,718,296 | B2 | 6/2020 | Hayatani et al. | |
| 10,753,331 | B2 | 8/2020 | Iwa | F16F 1/048 |
| 2002/0153209 | A1 | 10/2002 | Nagy | F16F 9/04 |
| 2003/0164161 | A1 | 9/2003 | Usui | F02M 59/366 |
| 2005/0019188 | A1 | 1/2005 | Usui et al. | F04B 11/00 |
| 2006/0071381 | A1 | 4/2006 | Hatakeyama | 267/140.13 |
| 2006/0272144 | A1 | 12/2006 | Matsuki | B23K 26/125 |
| 2007/0079810 | A1 | 4/2007 | Usui | F02M 63/028 |
| 2008/0175735 | A1 | 7/2008 | Lucas | F02M 37/0041 |
| 2008/0289713 | A1 | 11/2008 | Munakata et al. | 138/26 |
| 2009/0288639 | A1 | 11/2009 | Usui et al. | |
| 2010/0209274 | A1 | 8/2010 | Oikawa | F04B 53/004 |
| 2010/0215529 | A1 | 8/2010 | Inoue | F04B 53/002 |
| 2011/0103985 | A1 | 5/2011 | Mancini et al. | F04B 11/00 |
| 2011/0108007 | A1 | 5/2011 | Manchini | F04B 1/0448 |
| 2011/0110807 | A1 | 5/2011 | Kobayashi | F04B 1/0452 |
| 2011/0110808 | A1 | 5/2011 | Inoue | F04B 11/0033 |
| 2011/0209687 | A1 * | 9/2011 | Schroeder | F02M 63/005 123/459 |
| 2011/0247488 | A1 | 10/2011 | Oikawa | F02M 59/44 |
| 2012/0006303 | A1 | 1/2012 | Usui | F02M 59/44 |
| 2012/0087817 | A1 | 4/2012 | Lucas | F04B 1/0404 |
| 2012/0195780 | A1 | 8/2012 | Matsumoto | F02M 59/02 |
| 2013/0001842 | A1 | 1/2013 | Kanaya | 267/140.13 |
| 2013/0052064 | A1 | 2/2013 | Oikawa | F04B 11/0016 |
| 2013/0209289 | A1 | 8/2013 | Lucas | F04B 43/02 |
| 2013/0230417 | A1 | 9/2013 | Kobayashi | F16L 55/0338 |
| 2013/0276929 | A1 | 10/2013 | Oikawa | F02M 59/102 |
| 2014/0193280 | A1 | 7/2014 | Saito | F04B 11/00 |
| 2014/0216418 | A1 | 8/2014 | Asayama | F02M 69/02 |
| 2015/0017040 | A1 * | 1/2015 | Hishinuma | F02M 55/04 417/540 |
| 2015/0132165 | A1 | 5/2015 | Inoue | F02M 37/043 |
| 2015/0260133 | A1 | 9/2015 | Iwa | 92/47 |
| 2015/0260182 | A1 | 9/2015 | Kobayshi | F04B 43/02 |
| 2016/0169173 | A1 | 6/2016 | Yabuuchi | F02M 59/44 |
| 2016/0195084 | A1 * | 7/2016 | Koehler | F02M 55/04 92/143 |
| 2016/0298581 | A1 | 10/2016 | Nah et al. | F02M 37/0041 |
| 2017/0276130 | A1 | 9/2017 | Usui et al. | F04B 53/14 |
| 2017/0335810 | A1 | 11/2017 | Tomitsuka et al. | F02M 37/0041 |
| 2017/0350354 | A1 | 12/2017 | Ostrosky et al. | F02M 37/00 |
| 2018/0171992 | A1 | 6/2018 | Saito | F02M 59/44 |
| 2018/0195478 | A1 | 7/2018 | Iwa | F16L 1/06 |
| 2018/0202401 | A1 | 7/2018 | Iwa et al. | F02M 55/04 |
| 2018/0209389 | A1 | 7/2018 | Iwa | F16L 55/054 |
| 2018/0223782 | A1 * | 8/2018 | Yabuuchi | F02M 55/04 |
| 2018/0274525 | A1 | 9/2018 | Schretling | F04B 11/00 |
| 2018/0306368 | A1 | 10/2018 | Yoshida et al. | F16L 55/053 |
| 2018/0328322 | A1 | 11/2018 | Kashiwagi | F02M 37/0041 |
| 2019/0024646 | A1 | 1/2019 | Kurt | F04B 11/0033 |
| 2019/0048837 | A1 * | 2/2019 | Mikhaylov | F04B 53/16 |
| 2019/0063388 | A1 * | 2/2019 | Kurt | F02M 55/04 |
| 2019/0152455 | A1 | 5/2019 | Kai | B60T 17/00 |
| 2019/0285032 | A1 | 9/2019 | Mikhaylov | F04B 53/16 |
| 2021/0164430 | A1 | 6/2021 | Sata | F02M 59/44 |
| 2021/0215127 | A1 | 7/2021 | Kashiwagi | F04B 35/01 |
| 2021/0239080 | A1 | 8/2021 | Sato | F02M 59/36 |
| 2021/0246860 | A1 | 8/2021 | Iwa | F02M 59/48 |
| 2021/0285589 | A1 | 9/2021 | Iwa | F04B 11/0033 |

FOREIGN PATENT DOCUMENTS

| | | | |
|---|---|---|---|
| CN | 104066968 | 9/2014 | F02M 59/34 |
| CN | 107002615 | 8/2017 | F02N 59/44 |
| CN | 107429642 | 12/2017 | F02M 33/00 |
| DE | 102004002489 | 8/2005 | F04B 11/00 |
| DE | 10 2014 219 997 | 4/2016 | F04B 11/00 |
| DE | 10 2015 219 537 | 4/2017 | F04B 11/00 |
| DE | 10 2015 219 768 | 4/2017 | F02M 55/04 |
| DE | 10 2015 223 159 | 6/2017 | F02M 37/00 |
| DE | 10 2016 203 217 | 8/2017 | F02M 55/04 |
| DE | 10 2016 205 428 | 10/2017 | F04B 11/00 |
| JP | 10-299609 | 11/1998 | F02M 55/00 |
| JP | 2004138071 | 5/2004 | F02M 37/00 |
| JP | 2005-42554 | 2/2005 | F02M 59/44 |
| JP | 2007-218264 | 8/2007 | F02M 55/00 |
| JP | 2008-14319 | 1/2008 | F02M 59/44 |
| JP | 2009-264239 | 11/2009 | F02M 59/44 |
| JP | 2011-220196 | 11/2011 | F02M 59/44 |
| JP | 2012-197732 | 10/2012 | F02M 59/44 |
| JP | 2013-64364 | 4/2013 | F02M 59/44 |
| JP | 2014-190188 | 10/2014 | F02M 55/02 |
| JP | 2015-017585 | 1/2015 | |
| JP | 2015-017621 | 1/2015 | |
| JP | 2015-232283 | 12/2015 | F02M 55/00 |
| JP | 2016-113922 | 6/2016 | F02M 59/44 |
| JP | 2017-32069 | 2/2017 | F16F 9/04 |
| JP | 2018-71443 | 5/2018 | F02M 59/44 |
| KR | 10-2012-0090452 | 8/2012 | F02M 59/14 |
| WO | WO 2016/190096 | 1/2016 | F02M 59/44 |
| WO | WO 2017/022604 | 2/2017 | F16F 9/04 |
| WO | WO 2017022603 | 2/2017 | B23K 26/28 |
| WO | WO 2017167499 | 10/2017 | B23K 26/28 |
| WO | WO2017195415 | 11/2017 | |
| WO | WO2018056109 | 3/2018 | F02M 55/04 |

OTHER PUBLICATIONS

International Preliminary Report on Patentability issued in PCT/JP2019/019619, dated Nov. 24. 2020, with English translation, 10 pages.

International Search Report and Written Opinion issued in PCT/JP2019/019619, dated Aug. 13, 2019, with English translation, 18 pages.

International Preliminary Report on Patentability issued in PCT/JP2019/019618, dated Nov. 24. 2020, with English translation, 10pages.

International Search Report and Written Opinion issued in PCT/JP2019/019618, dated Jun. 25, 2019, with English translation, 19 pages.

International Preliminary Report on Patentability issued in PCT/JP2019/019616, dated Nov. 24, 2020, with English translation, 6 pages.

International Search Report and Written Opinion issued in PCT/JP2019/019616, dated Jul. 9, 2019, with English translation, 11 pages.

International Preliminary Report on Patentability issued in PCT/JP2019/020195, dated Dec. 1, 2020, with English translation, 7 pages.

International Search Report and Written Opinion issued in PCT/JP2019/020195, dated Jul. 30, 2019, with English translation, 12 pages.

International Preliminary Report on Patentability issued in PCT/JP2019/019615, dated Nov. 24, 2020, with English translation, 7 pages.

International Search Report and Written Opinion issued in PCT/JP2019/019615, dated Aug. 13, 2019, with English translation, 15 pages.

U.S. Appl. No. 17/048,980, filed Oct. 19, 2020, Sato et al.

U.S. Appl. No. 17/048,992, filed Oct. 19, 2020, Iwa et al.

U.S. Appl. No. 17/052,168, filed Oct. 30, 2020, Iwa et al.

(56) References Cited

OTHER PUBLICATIONS

Official Action dated Aug. 26, 2021, issued in related U.S. Appl. No. 17/052,168, 29 pages.
European Search Report issued in related European Application 19806549.2, dated Jan. 19, 2022, 6 pages.
Korean Official Action issued in related Korean Patent Application Serial No. 10-2020-7032120, dated Dec. 21, 2021 with translation (10 pages).
Supplemental European Search Report issued in corresponding European Patent Application No. 19803571.9, dated Jan. 19, 2022, 6 pages.
Official Action dated Jun. 18, 2021, issued in related U.S. Appl. No. 17/050,422, 15 pages.
Official Action dated Oct. 1, 2021, issued in related U.S. Appl. No. 17/048,568, 8 pages.
Official Action dated Sep. 21, 2021, issued in related U.S. Appl. No. 17/048,980, 19 pages.
Notice of Allowance dated Sep. 21, 2021, issued in related U.S. Appl. No. 17/762,111, 9 pages.
Notice of Allowance dated Oct. 19, 2021, issued in related U.S. Appl. No. 17/048,992, 7 pages.
Notice of Allowance dated Nov. 24, 2021 issued in related U.S. Appl. No. 17/052,168, 8 pages.
"Development of Optimal diaphragm-based pulsation damper structure for high-pressure GDI pump systems through design of experiments", NPL Scientific Journal Publication; retrieved Sep. 2, 2021, https://www.sciencedirect.com/science/article/pii/S0957415813000238 (Year 2013).
Chinese Official Action issued in related Chinese Patent Application Serial No. 201980025963.8, dated Sep. 28, 2021 (13 pages).
Chinese Official Action issued in related Chinese Patent Application Serial No. 201980026782.7, dated Oct. 9, 2021 (11 pages).
Chinese Official Action issued in related Chinese Patent Application Serial No. 201980026783.7, dated Oct. 9, 2021 (13 pages).
Chinese Official Action issued in related Chinese Patent Application Serial No. 201980029574.2, dated Oct. 11, 2021 (12 pages).
Chinese Official Action issued in related Chinese Patent Application Serial No. 201980029484.3, dated Oct. 11, 2021 (13 pages).
Official Action dated Jun. 24, 2021, issued in related U.S. Appl. No. 17/762,111, 21 pages.
Official Action dated Apr. 1, 2021, issued in related U.S. Appl. No. 17/762,111, 20 pages.
International Preliminary Report on Patentability issued in PCT/JP2018/042765, dated May 26, 2020, 5 pages.
International Search Report and Written Opinion issued in PCT/JP2018/042765, dated Feb. 12, 2019, with English translation, 15 pages.
Supplemental European Search Report issued in corresponding European Patent Application No. 18882045.0, dated Jun. 15, 2021, 7 pages.
Chinese Official Action issued in related Chinese Patent Application Serial No. 201880073747.6, dated Jun. 1, 2021 (17 pages).
Chinese Official Action issued in related Chinese Patent Application Serial No. 201880073747.6, dated Dec. 13, 2021 (15 pages).

* cited by examiner

DAMPER DEVICE

TECHNICAL FIELD

The present invention relates to a damper device that absorbs pulsation generated when liquid is sent by a pump or the like.

BACKGROUND ART

For example, when an engine or the like is to be driven, a high-pressure fuel pump is used to pump fuel, which is supplied from a fuel tank, to an injector. The high-pressure fuel pump pressurizes and discharges fuel by the reciprocation of a plunger that is driven by the rotation of a cam shaft of an internal-combustion engine.

As a mechanism for pressurizing and discharging fuel in the high-pressure fuel pump, an intake stroke for opening an intake valve and taking in fuel to a pressurizing chamber from a fuel chamber formed on a fuel inlet side, when the plunger is moved down, is performed first. Then, an amount adjustment stroke for returning a part of the fuel of the pressurizing chamber to the fuel chamber, when the plunger is moved up, is performed, and a pressurization stroke for pressurizing fuel, when the plunger is further moved up after the intake valve is closed, is performed. As described above, the high-pressure fuel pump repeats a cycle that includes the intake stroke, the amount adjustment stroke, and the pressurization stroke, to pressurize fuel and to discharge the fuel to the injector. Pulsation is generated in the fuel chamber when the high-pressure fuel pump is driven as described above.

In such a high-pressure fuel pump, a damper device for reducing pulsation generated in the fuel chamber is built in the fuel chamber. A damper device disclosed in, for example, Patent Citation 1 includes a disc-shaped damper body in which a space between two diaphragms is filled with gas. Since the damper body includes a deformable-action portion at the central portion thereof and the deformable-action portion is elastically deformed by fuel pressure accompanied by pulsation, the volume of the fuel chamber can be changed and pulsation is reduced.

The fuel chamber of the high-pressure fuel pump is formed as a space hermetically sealed from the outside by a device unit and a cup-shaped cover member surrounding a part of the device unit. When the damper device is installed in the fuel chamber, the cover member is mounted on the device unit after the damper device is placed on the device unit.

In the damper device disclosed in Patent Citation 1, upper and lower holding members are mounted on the outer peripheral edge portion of a diaphragm damper, are fitted to a recessed portion formed in a pump housing, and are then held by a damper cover and the pump housing. Accordingly, the diaphragm damper and the upper and lower holding members can be installed in a state where the diaphragm damper and the upper and lower holding members are not moved in the fuel chamber.

CITATION LIST

Patent Literature

Patent Citation 1: JP 2009-264239 A (page 14, FIG. 8)

SUMMARY OF INVENTION

Technical Problem

However, since the upper and lower holding members need to be mounted on the outer peripheral edge portion of the diaphragm damper and to be fitted to the recessed portion formed in the pump housing as described above in the damper device disclosed in Patent Citation 1, there is a problem that work for mounting the damper device is inconvenient.

The present invention has been made in consideration of such a problem, and an object of the present invention is to provide a damper device that can be held in a housing space with simple work.

Solution to Problem

In order to solve the above-mentioned problem, a damper device according to the present invention that is disposed and used in a housing space formed in a device unit including: a damper body that is filled with gas and includes a diaphragm provided with a deformable-action portion formed at a central portion thereof; and an annular clip that holds an outer peripheral edge portion of the damper body and causes a biasing force to act on an inner wall of the device unit, which defines the housing space, in a radial direction. According to the aforesaid feature or the present invention, the annular clip holding the damper body is installed so as to be press contact with the inner wall of the device unit, which forms the housing space, by the biasing force of the annular clip. Therefore, the damper device can be stably held in the housing space with simple work.

It may be preferable that the damper body includes a stay member fixed to the diaphragm and provided with a cylindrical portion that surrounds the deformable-action portion of the diaphragm and that is brought into contact with the annular clip. According to this preferable configuration, since the stay member is brought into contact with the annular clip, a biasing force applied by the annular clip can be received by the stay member. Accordingly, it is possible to mount the damper body on the device unit without affecting the deformable-action portion of the diaphragm.

It may be preferable that the annular clip has an uneven shape in the circumferential direction. According to this preferable configuration, since the annular clip has an uneven shape in the circumferential direction, the annular clip is easily deformed in the radial direction and can be in contact with the inner wall of the device unit, which forms the housing space, at a plurality of position in the circumferential direction and cause a biasing force to act on the inner wall.

It may be preferable that a groove portion with which the outer peripheral edge portion of the damper body is to be engaged is formed in a concave portion partially forming the uneven shape of the annular clip. According to this preferable configuration, since the groove portion is formed in the concave portion of the annular clip, the annular clip is easily deformed in the radial direction. Since the outer diameter of the annular clip is easily reduced, work for mounting the damper device is easily performed. Further, since the annular clip is present on both sides of the outer peripheral edge portion in a direction where the diaphragm is to be deformed (that is, in the axial direction of the diaphragm), the damper body is not separated from the annular clip.

It may be preferable that the concave portion of the annular clip includes an inner peripheral end portion having the shape of a circular arc along the cylindrical portion of the stay member. According to the fifth aspect, since the contact area between the cylindrical portion of the stay member and the concave portion of the annular clip can be increased, a frictional force can be increased and the stay member and the annular clip can be more reliably fixed to each other.

It may be preferable that the stay member is provided with a plurality of through-holes arranged in a circumferential direction so as to penetrate the stay member in the radial direction. According to this preferable configuration, since a space around the stay member and a space around the diaphragm can communicate with each other through the through-holes and the diaphragm can be exposed to fluid present in the housing space, pulsation reduction performance can be ensured.

It may be preferable that a plurality of hole portions penetrating the annular clip in the radial direction are formed in the annular clip so as to be arranged in the circumferential direction. According to the seventh aspect, since a space outside the annular clip and a space inside the annular clip can communicate with each other through the hole portions and the diaphragm positioned inside the annular clip can be exposed to fluid present in the housing space, pulsation reduction performance can be ensured.

DESCRIPTION OF EMBODIMENTS

A mode for implementing a damper device according to the present invention will be described below on the basis of an embodiment.

EMBODIMENT

A damper device according to an embodiment of the present invention will be described with reference to FIGS. 1 to 7.

Figure 1:
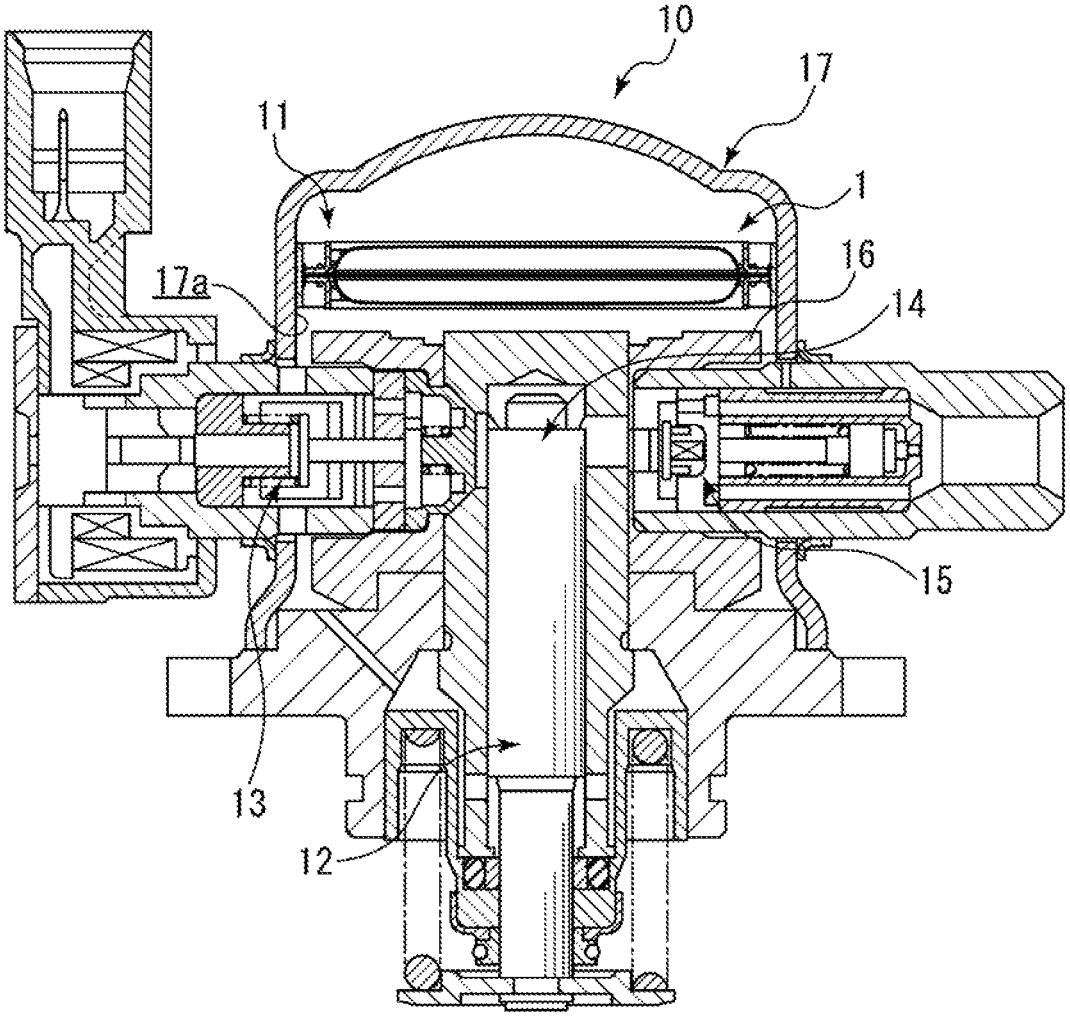
FIG. 1 is a cross-sectional view of a high-pressure fuel pump in which a damper device according to an embodiment of the present invention is built.

As illustrated in FIG. 1, the damper device 1 according to the present embodiment is built in a high-pressure fuel pump 10 for pumping fuel, which is supplied from a fuel tank through a fuel inlet (not illustrated), to an injector. The high-pressure fuel pump 10 pressurizes and discharges fuel by the reciprocation of a plunger 12 that is driven by the rotation of a cam shaft (not illustrated) of an internal-combustion engine.

As a mechanism for pressurizing and discharging fuel in the high-pressure fuel pump 10, an intake stroke for opening an intake valve 13 and taking in fuel to a pressurizing chamber 14 from a fuel chamber 11 formed on a fuel inlet side, when the plunger 12 is moved down, is performed first. Then, an amount adjustment stroke for returning a part of the fuel of the pressurizing chamber 14 to the fuel chamber 11, when the plunger 12 is moved up, is performed, and a pressurization stroke for pressurizing fuel, when the plunger 12 is further moved up after the intake valve 13 is closed, is performed.

As described above, the high-pressure fuel pump 10 repeats a cycle that includes the intake stroke, the amount adjustment stroke, and the pressurization stroke, to pressurize fuel, to open a discharge valve 15, and to discharge the fuel to the injector. In this case, pulsation in which high pressure and low pressure are repeated is generated in the fuel chamber 11. The damper device 1 is used to reduce such pulsation that is generated in the fuel chamber 11 of the high-pressure fuel pump 10.

Figure 2:
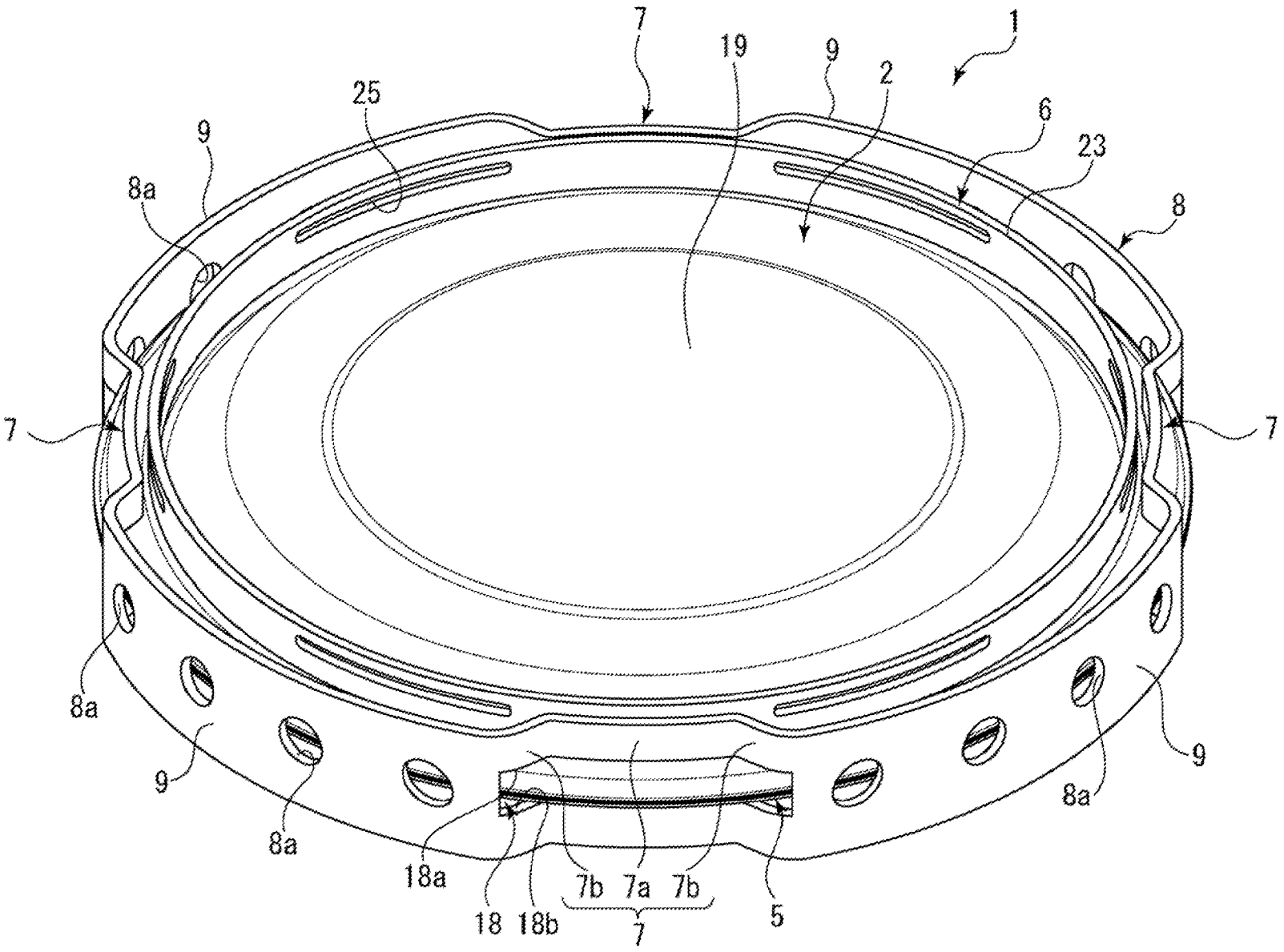
FIG. 2 is a perspective view of the damper device in the embodiment.
Figure 3:
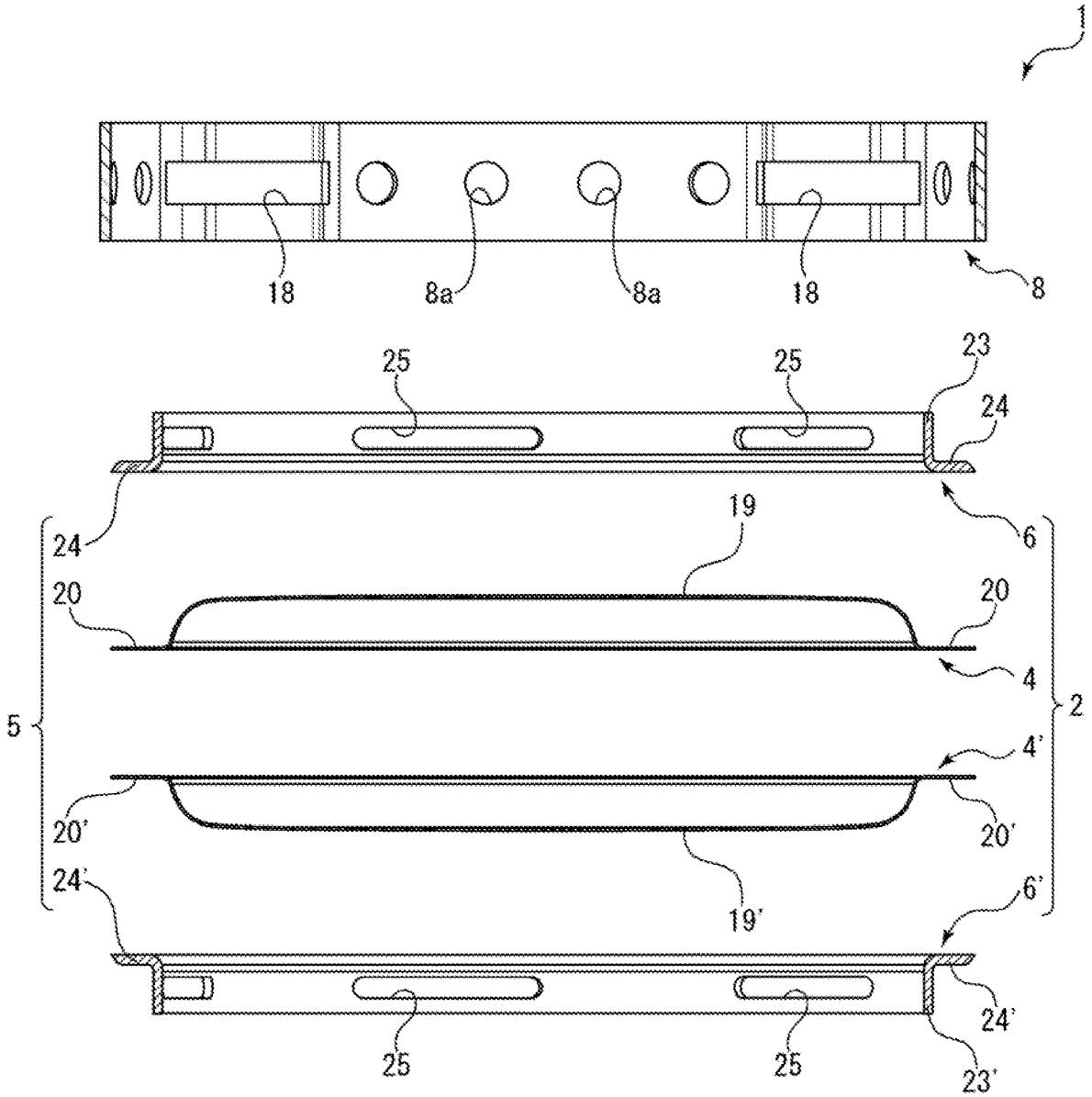
FIG. 3 is an exploded cross-sectional view illustrating components of the damper device in the embodiment.

As illustrated in FIGS. 2 and 3, the damper device 1 includes a damper body 2 and an annular clip 8, and the damper body 2 includes diaphragms 4 and 4' having shapes symmetrical to each other and stay members 6 and 6' fixed to end portions of the diaphragms 4 and 4' in an axial direction.

The diaphragm 4 is formed in the shape of a dish to have a uniform thickness as a whole by the pressing of a metal plate. A deformable-action portion 19 bulging in the axial direction is formed on the radially central side of the diaphragm 4, and an outer peripheral edge portion 20 having the shape of an annular flat plate is formed on the outer peripheral side of the deformable-action portion 19 to extend radially outward from the deformable-action portion 19. The diaphragm 4 is adapted so that the deformable-action portion 19 is easily deformed in the axial direction by fluid pressure in the fuel chamber 11. Since the diaphragm 4' has the same structure as the diaphragm 4, the description of the diaphragm 4' will be omitted.

The outer peripheral edge portion 20 of the diaphragm 4 and the outer peripheral edge portion 20' of the diaphragm 4' are fixed to each other in a circumferential direction by welding so as to be in a hermetically sealed state, and a hermetically sealed space formed in the damper body 2 is filled with gas that is formed of argon, helium, and the like and has predetermined pressure. Meanwhile, the amount of change in the volume of the damper body 2 is adjusted using the internal pressure of gas to be filled in the damper body 2, so that desired pulsation absorption performance can be obtained.

As illustrated in FIGS. 2 and 3, the stay member 6 is adapted to have a uniform thickness as a whole by the pressing of a metal plate, surrounds the deformable-action portion 19 of the diaphragm 4 in the circumferential direction, and includes an annular cylindrical portion 23 in which a through-hole penetrating itself in the axial direction is formed. An outer peripheral edge portion 24 is formed on the outer peripheral side of the cylindrical portion 23. Further, a plurality of through-holes 25 long in the circumferential direction are formed in the cylindrical portion 23 to be spaced apart from each other in the circumferential direction.

Figure 7:
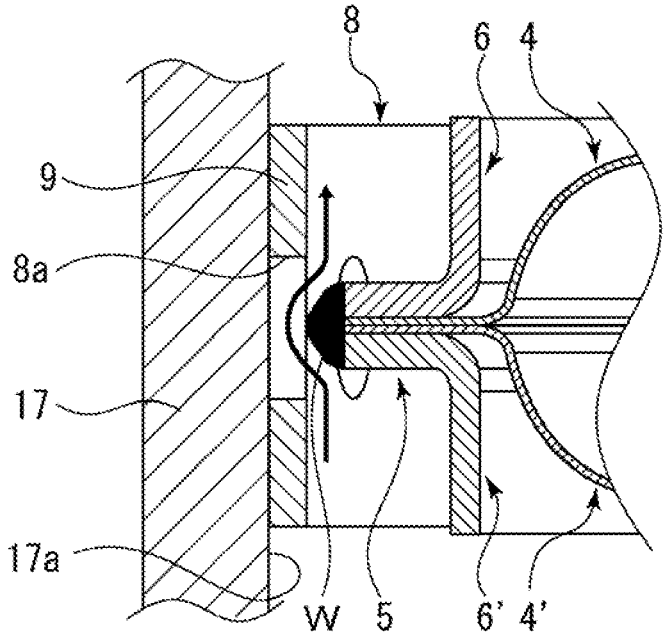
FIG. 7 is an enlarged cross-sectional view illustrating the structure of a hole portion that is formed in the annular clip in the embodiment.

As illustrated in FIGS. 2 and 7, the outer peripheral edge portion 20 of the diaphragm 4, the outer peripheral edge portion 24 of the stay member 6, the outer peripheral edge portion 20' of the diaphragm 4', and the outer peripheral edge portion 24' of the stay member 6' are fixed to each other at a welded portion W in the circumferential direction by welding, and form an outer peripheral edge portion 5 of the damper body 2. Since the diaphragms 4 and 4' and the stay members 6 and 6' are integrally fixed, not only it is easy to assemble the damper body 2 but also it is possible to prevent the deformable-action portion 19 of the diaphragm 4 from being broken due to a collision between the deformable-action portion 19 of the diaphragm 4 and the cylindrical portion 23 of the stay member 6.

As illustrated in FIGS. 2 and 3, the annular clip 8 is adapted to have a uniform thickness as a whole by the pressing of a metal plate, and has the shape of a tube surrounding the annular cylindrical portions 23 and 23' of the stay members 6 and 6', which are positioned on both sides in the axial direction, in the circumferential direction. The annular clip 8 has an uneven shape (for example, the shape of a spline or the shape of a gear) in the circumferential direction. In detail, the metal plate forming the annular clip 8 is bent in a radial direction, so that four concave portions 7 recessed radially inward are formed on the annular clip 8 so as to be spaced apart from each other in the circumferential direction and convex portions 9 are formed between the concave portions 7. A plurality of circular hole portions 8*a* penetrating the annular clip 8 in the radial direction are formed in the convex portions 9 so as to be spaced apart from each other in the circumferential direction.

Each of the concave portions 7 of the annular clip 8 includes an inner peripheral end portion 7*a* that is formed in the shape of a circular arc, and connecting portions 7*b* and 7*b*. The connecting portions 7*b* and 7*b* connect the inner peripheral end portion 7*a* to the convex portions 9 and 9 that are adjacent to the inner peripheral end portion 7*a* and positioned on both sides of the inner peripheral end portion 7*a* in the circumferential direction. Further, since the convex portions 9 are also formed in the shape of a circular arc, the inner peripheral end portions 7*a* of the concave portions 7 and the convex portions 9 are formed in the shapes of concentric circular arcs.

Long holes 18 as groove portions penetrating the annular clip 8 in the radial direction are formed in the concave portions 7 of the annular clip 8. In detail, each long hole 18 is formed in the middle portion of the concave portion 7 in a height direction so as to be continuous in the circumferential direction over the inner peripheral end portion 7*a* and both the connecting portions 7*b* and 7*b* of the concave portion 7. When the annular clip 8 and the damper body 2 are assembled with each other, the outer peripheral edge portion 5 of the damper body 2 is loosely fitted to the long holes 18 of the annular clip 8 as illustrated in FIG. 2.

The length of the long hole 18 in the axial direction is slightly larger than the thickness of the outer peripheral edge portion 5 of the damper body 2 that is formed by the outer peripheral edge portions 20 and 20' of the diaphragms 4 and 4' and the outer peripheral edge portions 24 and 24' of the stay members 6 and 6'. Accordingly, when the annular clip 8 and the damper body 2 are assembled with each other, the movement of the damper body 2 in the height direction is restricted by both end portions 18*a* and 18*b* of each long hole 18 in the axial direction.

The concave portions 7 of the annular clip 8 are expanded radially outward and the outer peripheral edge portion 5 of the damper body 2 is engaged with the long holes 18 formed in the concave portions 7, so that the annular clip 8 and the damper body 2 are integrally unitized and form the damper device 1. Since the annular clip 8 is formed of a thin metal plate, the annular clip 8 has elasticity. Accordingly, when an external force for expanding the concave portions 7 radially outward does not act, the concave portions 7 move radially inward due to an elastic force and are made to be in a natural state. As a result, a state where the outer peripheral edge portion 5 of the damper body 2 is held in the long holes 18 can be maintained.

Figure 4:
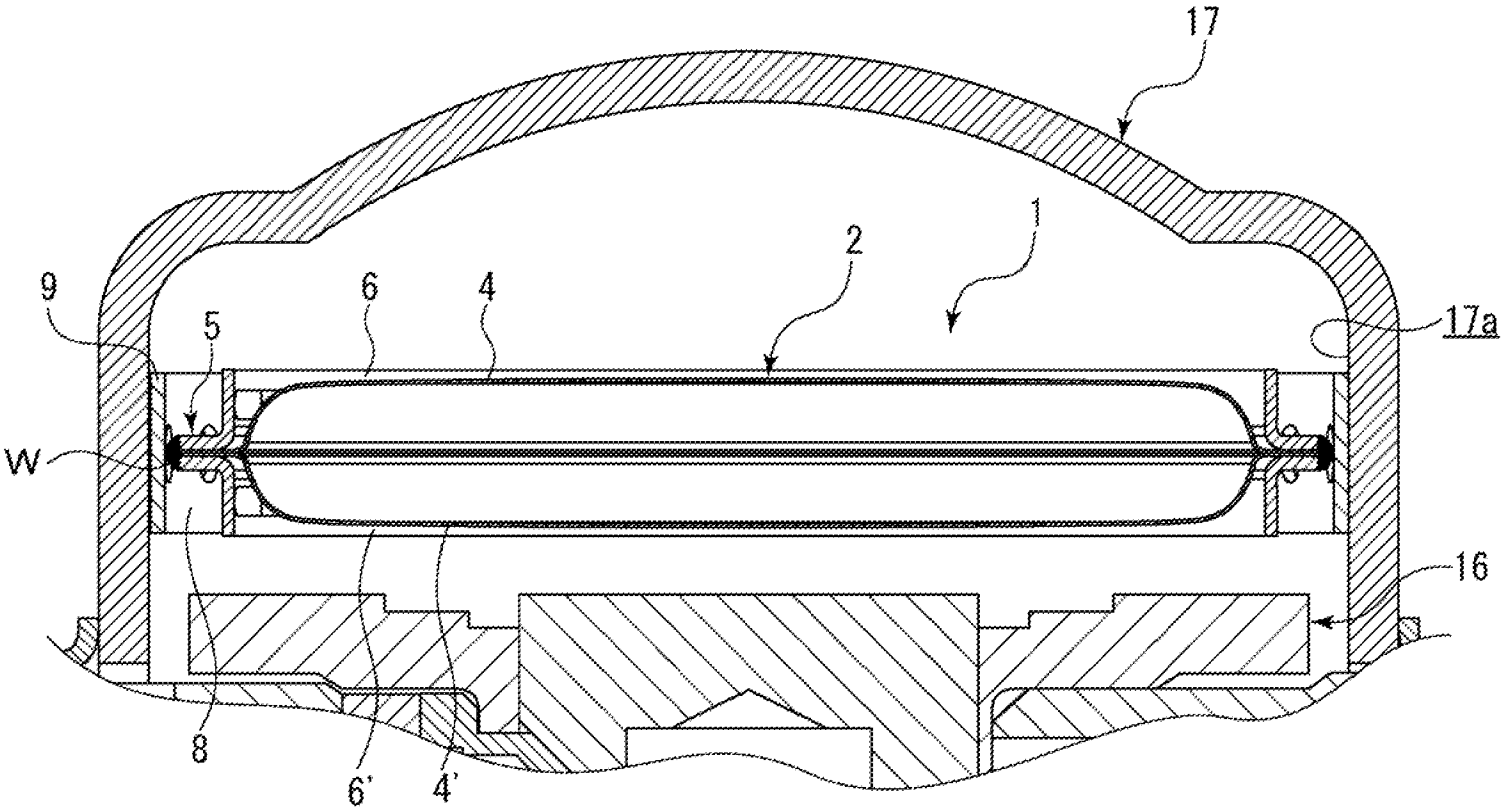
FIG. 4 is a cross-sectional view illustrating a state where the installation of the damper device in a housing space is completed in the embodiment.

Since the inner peripheral end portions 7*a* of the concave portions 7 of the annular clip 8 are close to the cylindrical portions 23 and 23' of the stay members 6 and 6' forming the outer peripheral wall portion of the damper body 2 in the natural state as illustrated in FIG. 2, the relative movement of the damper body 2 and the annular clip 8 in the radial direction is restricted. Further, since the height of the damper body 2 is larger than the height of the annular clip 8 as illustrated in FIG. 4, the end portions of the cylindrical portions 23 and 23' of the stay members 6 and 6' protrude from the end portions of the annular clip 8 in the height direction in a state where the damper body 2 and the annular clip 8 are assembled with each other. In addition, since the deformable-action portions 19 and 19' of the diaphragms 4 and 4' have dimensions that do not allow the deformable-action portions 19 and 19' to protrude from the end portions of the cylindrical portions 23 and 23' of the stay members 6 and 6' in the height direction, an external force acting on the damper device 1 in a vertical direction acts on the stay members 6 and 6' during the installation or use of the damper device 1. Accordingly, the breakage or deformation of the annular clip 8 or the deformable-action portions 19 and 19' of the diaphragms 4 and 4' can be prevented.

Further, since the outer peripheral edge portion 5 of the damper body 2 except for a portion thereof, which is exposed to the outside from the long holes 18, is positioned on the inner peripheral side of the convex portions 9 of the annular clip 8 as illustrated in FIG. 2, the movement of the damper body 2 in the radial direction is restricted by these convex portions 9. Accordingly, the damper body 2 is not in direct contact with an inner peripheral surface 17*a* of a cover member 17 to be described later that forms the fuel chamber 11. Furthermore, since the movement of the damper body 2 in the radial direction is restricted by the convex portions 9 of the annular clip 8, the inner peripheral end portions 7*a* of the concave portion 7 and the convex portions 9 of the annular clip 8 are formed in the shapes of circular arcs concentric with the outer peripheral edge portion 5 of the damper body 2.

Next, the pulsation absorption of the damper device 1, when the damper device 1 receives fuel pressure accompanied by pulsation in which high pressure and low pressure are repeated, will be described. When fuel pressure accompanied by pulsation is changed to high pressure from low pressure and fuel pressure generated from the fuel chamber 11 is applied to the diaphragms 4 and 4', the deformable-action portions 19 and 19' are crushed inward and the gas filled in the damper body 2 is compressed. Since the deformable-action portions 19 and 19' are elastically deformed by fuel pressure accompanied by pulsation, the volume of the fuel chamber 11 can be changed and pulsation is reduced.

Figure 5:
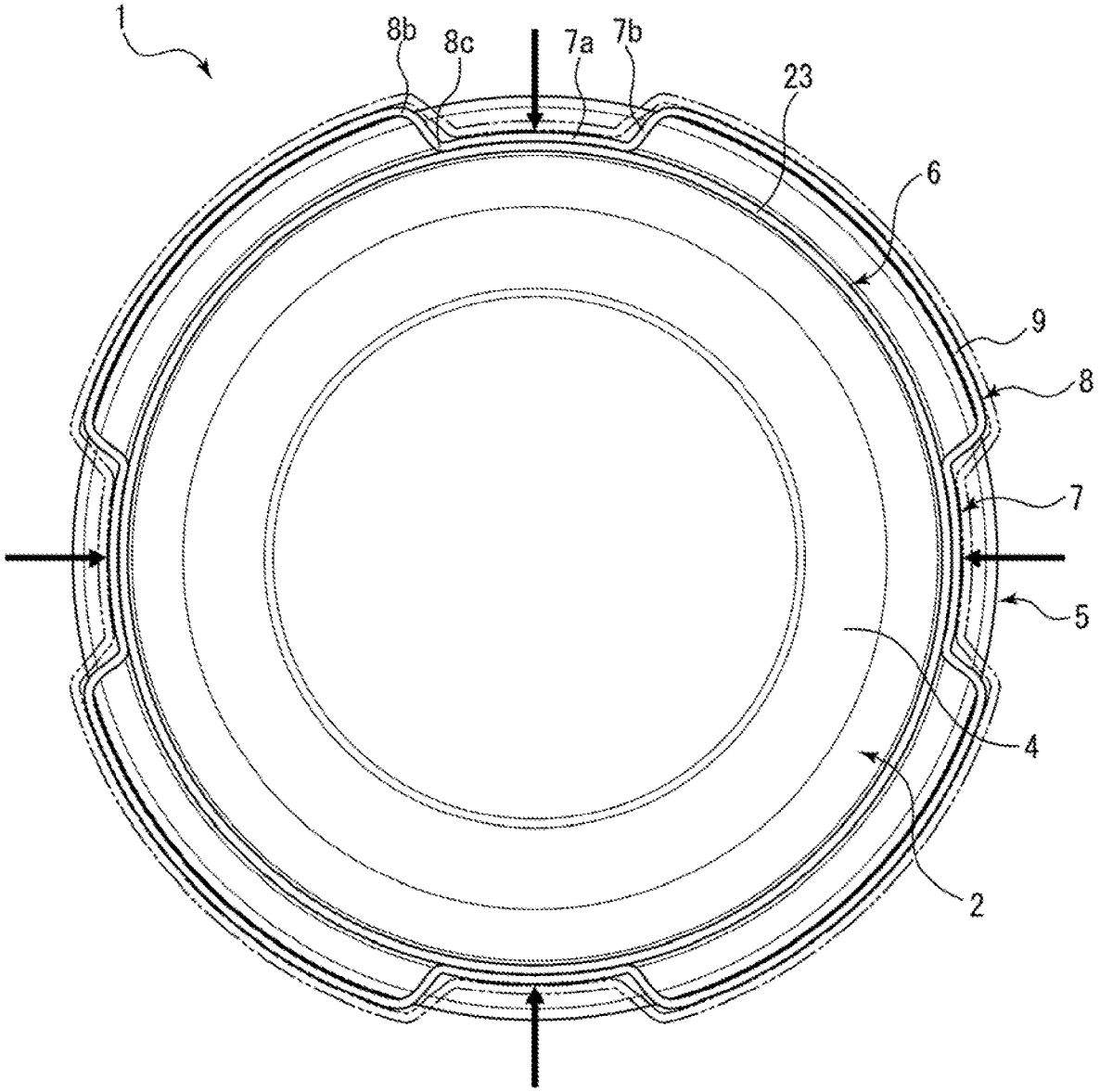
FIG. 5 is a top view illustrating an aspect of the reduction of the outer diameter of an annular clip of the damper device in the embodiment.

Next, a process for installing the damper device 1 will be described with reference to FIGS. 1, 4, and 5. As illustrated in FIGS. 1 and 4, the fuel chamber 11 serving as a housing space of the high-pressure fuel pump 10 serving as a device unit is formed by a pump body 16 and a cover member 17 that surrounds a part of the pump body 16.

First, the unitized damper device 1 is disposed inside the cover member 17. In this case, since the outer diameter of the annular clip 8 in the natural state is slightly larger than the inner diameter of the cover member 17, the damper device 1 is disposed to be inserted into the cover member 17 in a state where an external force is applied to the concave portions 7 or the convex portions 9 of the annular clip 8 inward in the radial direction and the outer diameter of the annular clip 8 is reduced in advance as illustrated in FIG. 5 so that the annular clip 8 can be inserted into the cover member 17.

An aspect of the reduction of the diameter will be described with reference to FIG. 5. When an external force is applied to the concave portions 7 or the convex portions 9 inward in the radial direction, the connecting portions 7*b* and 7*b* are displaced to approach the convex portions 9 on the inner peripheral side about shoulder portions 8*b* and shoulder portions 8*c* as fulcrums and the convex portions 9 are moved inward in the radial direction in an aspect where the convex portions 9 are pulled by the connecting portions 7*b* and 7*b*. As a result, the outer diameter of the annular clip 8 is reduced. Here, the shoulder portions 8*b* are boundary portions between the convex portions 9 and the connecting portions 7*b* and 7*b* of the concave portions 7 of the annular clip 8, and the shoulder portions 8*c* are boundary portions between the inner peripheral end portions 7*a* and the connecting portions 7*b* and 7*b* of the concave portion 7.

Meanwhile, the annular clip 8 may be disposed to be inserted in a state where the outer diameter of the annular clip 8 is reduced in advance by, for example, a jig. In this case, when the jig is adapted to apply an external force to the concave portions 7 of the annular clip 8 inward in the radial direction, the jig is hardly in contact with the inner peripheral surface 17*a* of the cover member 17 and this work is easily performed. In addition, when the annular clip 8 is adapted to be pressed by an open end portion (not illustrated) of the cover member 17, that is, when the damper device 1 is adapted to be press-fitted into the cover member 17, a process for reducing the outer diameter of the annular clip in advance may be omitted. Finally, after the cover member 17 is made to be in contact with the pump body 16 from above, the pump body 16 and the cover member 17 are liquid-tightly fixed to each other using fastening means, such as screws.

Figure 6:
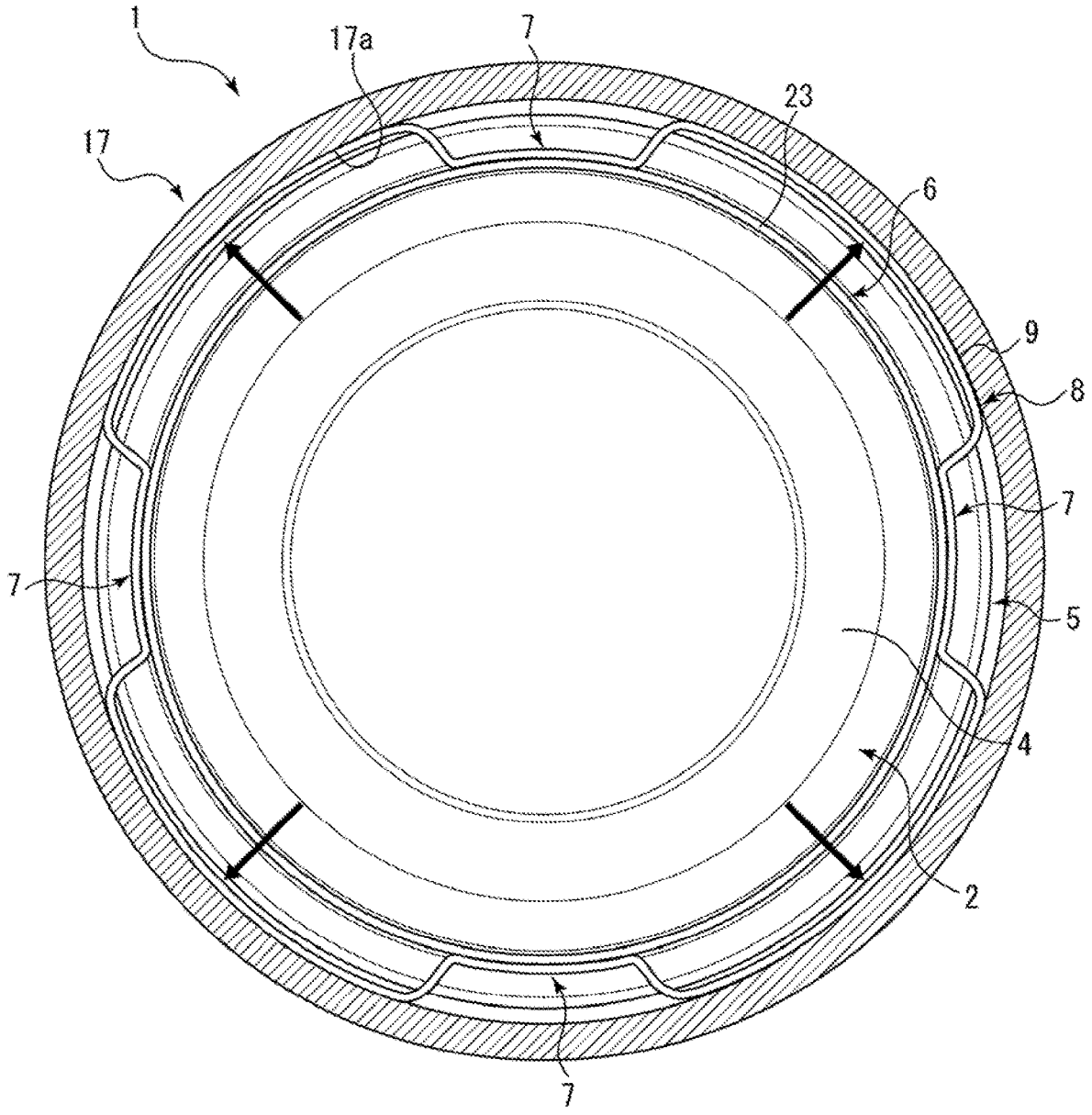
FIG. 6 is a top cross-sectional view illustrating a state where the installation of the damper device in the housing space is completed in the embodiment.

The convex portions 9 of the annular clip 8 are biased to the inner peripheral surface 17*a* of the cover member 17 by the elastic restoring force of the annular clip 8 as illustrated in FIG. 6, so that the movement of the annular clip 8 relative to the cover member 17 is suppressed by friction caused by a biasing force.

The concave portions 7 of the annular clip 8 are biased to the cylindrical portions 23 and 23' of the stay members 6 and 6', so that the movement of the damper body 2 relative to the annular clip 8 is suppressed by friction caused by a biasing force. Accordingly, since the annular clip 8 is stably disposed in the cover member 17, the damper body 2 held by the annular clip 8 is stably installed in the cover member 17. Further, the outer peripheral edge portion 5 is inserted into the long holes 18 of the annular clip 8, so that the annular clip 8 is present on both sides of the outer peripheral edge portion 5 in a direction where the diaphragms 4 and 4' are to be deformed. Accordingly, even though a large force is applied to the damper body 2, the damper body 2 is not separated from the annular clip 8.

As long as the annular clip 8 is merely disposed to be inserted into the cover member 17, which forms the fuel chamber 11 serving as a housing space, in a state where the outer diameter of the annular clip 8 of the damper device 1 is reduced as described above, the damper device 1 can be stably held in the cover member 17 by the biasing force of the annular clip 8. Accordingly, the damper device 1 can be installed in the housing space with simple work.

Further, since the inner peripheral end portions 7*a* of the concave portions 7 are formed in the shape of a circular arc along the shape of the outer periphery of the cylindrical portions 23 and 23' of the stay members 6 and 6', the central axis of the annular clip 8 and the central axes of the stay members 6 and 6' coincide with each other and contact points between the inner peripheral end portions 7*a* and the cylindrical portions 23 and 23' are increased. Accordingly, a frictional force can be increased.

Furthermore, as described above, the outer peripheral edge portion 5 of the damper body 2 except for a portion thereof, which is exposed to the outside from the long holes 18, is positioned on the inner peripheral side of the convex portions 9 of the annular clip 8 and is not indirect contact with the inner peripheral surface 17*a* of the cover member 17. Accordingly, gaps are formed between portions of the outer peripheral edge portion 5 of the damper body 2, which are exposed to the outside from the long holes 18 formed in the concave portions 7 of the annular clip 8, and the inner peripheral surface 17*a* of the cover member 17; two spaces partitioned in the fuel chamber 11 by the damper device 1 communicate with each other through the gaps; and the diaphragms 4 and 4' facing the respective spaces can be exposed to fluid flowing into the fuel chamber 11.

Moreover, the outside of the stay members 6 and 6', that is, the interior space of the fuel chamber 11 and the inside of the stay members 6 and 6', that is, the space around the damper body 2 communicate with each other through the through-holes 25 formed in the cylindrical portions 23 and 23' of the stay members 6 and 6'.

Further, the outside of the annular clip 8, that is, the interior space of the fuel chamber 11 and the space around the stay members 6 and 6' communicate with each other through the hole portions 8*a* formed in the convex portions 9 of the annular clip 8 and the gaps formed between the inner peripheral surface 17*a* of the cover member 17 and the outer peripheral edge portion 5 of the damper body 2.

Furthermore, since the length of each hole portion 8*a*, which is formed in the convex portions 9 of the annular clip 8, in the height direction is larger than the thickness of the outer peripheral edge portion 5 of the damper body 2 as illustrated in FIG. 7, the space around the stay member 6 and the space around the stay member 6' partitioned by the outer peripheral edge portion 5 of the damper body 2 communicate with each other through the hole portions 8*a*.

A member to be in contact with the inner peripheral surface of the housing space is formed in an annular shape as described above. Accordingly, while the damper device 1 can be stably held in the fuel chamber 11, fuel pressure, which is accompanied by pulsation in which high pressure and low pressure generated in the fuel chamber 11 are repeated, can be made to directly act on the damper body 2, so that sufficient pulsation reduction performance can be ensured.

Further, since the outer diameter of the annular clip 8 is reduced and the damper device 1 is held on the inner peripheral surface of the housing space by the biasing force of the annular clip 8, not only the damper device 1 can be mounted in housing spaces having different dimensions within a range where the outer diameter of the annular clip 8 can be reduced but also excessively high machining accuracy is not needed when the outer diameter of the damper device 1 is to be fitted to the inner diameter of the housing space.

Furthermore, a metal ring having an endless shape is bent to have an uneven shape in the circumferential direction, so that the annular clip 8 is formed. Accordingly, structural strength can be secured; and radial biasing forces can be equally applied to the inner peripheral surface 17*a* of the cover member 17 forming the fuel chamber 11 at four positions by the four convex portions 9, so that the central axis of the fuel chamber 11 and the central axis of the annular clip 8 can be aligned with each other.

Further, since the outer peripheral surfaces of the convex portions 9 of the annular clip 8 are formed in the shape of a circular arc along the inner peripheral surface 17*a* of the cover member 17 forming the fuel chamber 11, the bias of the biasing force acting on the inner peripheral surface 17*a* of the cover member 17 can be prevented. Accordingly, the damper device 1 can be stably held in the cover member 17.

The embodiment of the present invention has been described above with reference to the drawings, but specific configuration is not limited to the embodiment. Even though modifications or additions are provided without departing from the scope of the present invention, the modifications or additions are included in the present invention.

For example, the damper device 1 of which the diaphragm 4 and the stay member 6 are fixed to each other by welding has been described in the embodiment, but the present invention is not limited thereto. For example, the diaphragm 4 and the stay member 6 may be integrally unitized by being assembled with the annular clip 8 without being fixed to each other. Further, the diaphragm 4 may be directly assembled with the stay member 6.

Furthermore, one stay member 6 and the other stay member 6' may not have the same shape.

Moreover, an aspect where the damper device 1 is provided in the fuel chamber 11 of the high-pressure fuel pump 10 to reduce pulsation in the fuel chamber 11 has been described in the embodiment, but the present invention is not limited thereto. For example, the damper device 1 may be provided on a fuel pipe or the like connected to the high-pressure fuel pump 10 to reduce pulsation.

Further, when the damper device 1 is disposed so that the stay members 6 and 6' are in contact with the lower end face of the cover member 17 forming the fuel chamber 11 and the end face of the pump body 16, respectively, the movement of the damper device 1 in a direction where the diaphragms 4 and 4' are to be deformed can be reliably restricted.

Furthermore, the annular clip 8 is not limited to an endless shape, and may be formed in a C shape which is not an endless shape and in which end portions are spaced apart from each other or may be formed in a shape where end portions partially overlap with each other.

Further, structure allowing the space around the stay member 6 and the space around the stay member 6', which are partitioned by the outer peripheral edge portion 5 of the damper body 2, to communicate with each other is not limited to the hole portions 8*a* formed in the convex portions 9 of the annular clip 8 of the embodiment. For example, vertical grooves continuous in the height direction may be formed in the inner peripheral surfaces or the outer peripheral surfaces of the convex portions 9 of the annular clip 8.

Structure allowing the outer peripheral edge portion 5 of the damper body 2 and the annular clip 8 to be engaged with each other is not limited to the long holes 18 of the annular clip 8 of the embodiment. For example, groove portions extending in the circumferential direction may be formed in the inner peripheral surfaces of the concave portions 7 of the annular clip 8.

REFERENCE SIGNS LIST

1 Damper device
2 Damper body
4 Diaphragm
5 Outer peripheral edge portion of damper body
6 Stay member
7 Concave portion
7*a* Inner peripheral end portion
7*b* Connecting portion
8 Annular clip
9 Convex portion
10 High-pressure fuel pump (device unit)
11 Fuel chamber (housing space)
12 Plunger
13 Intake valve
14 Pressurizing chamber
15 Discharge valve
16 Pump body
17 Cover member
17*a* Inner peripheral surface
18 Long hole (groove portion)
19 Deformable-action portion
20 Outer peripheral edge portion of diaphragm
23 Cylindrical portion
24 Outer peripheral edge portion of stay member
25 Through-hole

The invention claimed is:

1. A damper device that is installed and used in a housing space formed in a device unit, the housing space having fluid housed therein, the damper device comprising a damper body and an annular clip formed separately from the damper body, a damper body being constituted by a diaphragm and a stay member, the diaphragm being filled with gas and provided with a deformable-action portion formed at a central portion thereof and an outer peripheral edge portion formed on a radially outside of the deformable-action portion, the stay member being provided with a cylindrical portion surrounding the deformable-action portion of the diaphragm and an outer peripheral edge portion fixed to the outer peripheral edge portion of the diaphragm, the annular clip being detachably coupled with the damper body so as to hold the outer peripheral edge portion of the stay member, the annular clip having an uneven shape formed by concave portions and convex portions alternatively arranged in the circumferential direction, the concave portion being recessed in a radially inward direction and having a diameter smaller than a diameter of the outer periphery portion of the stay member, the convex portion being protruded in a radially outward direction and having a diameter larger than the diameter of the outer periphery portion of the stay member, each of the concave portions being provided with a slot portion to which the outer peripheral edge portion of the stay member loosely fitted and an inner peripheral end portion having the shape of a circular arc along the cylindrical portion of the stay member, each of the convex portions being formed so as to have a diameter slightly larger than a diameter of an inner wall of the device unit defining the housing space in a natural state, upon a coupling of the annular clip with the damper body, the outer periphery portion of the stay member being loosely fitted to the slot of each of the concave portions of the annular clip while the diameter of the concave portion being enlarging, and upon an installation of the damper device in the device unit, the damper device is inserted to the housing space of the device unit while the diameter of each of the convex portions being reduced and then causes a biasing force to act on the inner wall of the device unit in the radially outward direction by releasing a reduction of the diameter of the each of the convex portions.

2. The damper device according to claim 1, wherein the stay member is provided with a plurality of through-holes arranged in a circumferential direction so as to enable the fluid of the housing space to penetrate the stay member in the radial direction.

3. The damper device according to claim 1, wherein a plurality of hole portions enabling the fluid of the housing space to penetrate the annular clip in the radial direction are formed in the annular clip so as to be arranged in the circumferential direction.

4. The damper device according to claim 1, wherein a plurality of hole portions enabling the fluid to penetrate the annular clip in the radial direction are formed in the annular clip so as to be arranged in the circumferential direction.

* * * * *